US006508085B1

(12) United States Patent
Byrne

(10) Patent No.: US 6,508,085 B1
(45) **Date of Patent: *Jan. 21, 2003**

(54) HORIZONTAL AXIS WASHER OR DRYER DOOR WITH VIEWING SYSTEM

(75) Inventor: Robert M. Byrne, Lima, OH (US)

(73) Assignee: American Trim, LLC, Lima, OH (US)

( * ) Notice: Subject to any disclaimer, the term of this patent is extended or adjusted under 35 U.S.C. 154(b) by 50 days.

This patent is subject to a terminal disclaimer.

(21) Appl. No.: 09/644,398

(22) Filed: Aug. 23, 2000

(51) Int. Cl.[7] ..... D06F 39/00

(52) U.S. Cl. ..... 68/3 R; 34/88; 134/113; 220/663; 362/91

(58) Field of Search ..... 68/3 R; 134/113; 34/88; 126/190, 200; 99/341; 359/809, 810; 220/663; 362/91

(56) References Cited

U.S. PATENT DOCUMENTS

| | | | | |
|---|---|---|---|---|
| 4,934,559 | A | 6/1990 | Putnam | 220/377 |
| 5,087,116 | A | 2/1992 | Taylor, II | 359/851 |
| 5,127,169 | A | 7/1992 | Ellingson | 34/133 F |
| 5,404,185 | A | 4/1995 | Vogeley et al. | 353/122 |
| D360,500 | S | 7/1995 | Millet et al. | D32/1 |
| 5,459,539 | A | 10/1995 | Yamamoto | 353/119 |
| 5,960,785 | A | 10/1999 | Byrne et al. | 126/200 |

*Primary Examiner*—Philip R. Coe
(74) *Attorney, Agent, or Firm*—Rankin, Hill, Porter & Clark LLP

(57) ABSTRACT

A door for a horizontal axis laundry appliance that includes an inner panel that closes the appliance and an outer panel spaced from the inner panel. The inner and outer panels are connected adjacent their upper edges by an upper panel. The inner panel includes a first window in the form of a wide-angle lens. The upper panel includes a second window. Light-transmissive devices including a negative mirror are disposed between the inner and outer panels so as to direct light received through the lens upwardly and outwardly through the second window. The interior of the appliance is illuminated by low-voltage halogen lights mounted on the inner panel.

18 Claims, 7 Drawing Sheets

HORIZONTAL AXIS WASHER OR DRYER DOOR WITH VIEWING SYSTEM

BACKGROUND OF THE INVENTION (1) Field of the Invention

The invention generally relates to horizontal axis washers and dryers, particularly to washers and dryers for washing and drying clothes and, more particularly, to sealed and insulated washer and dryer doors having the capability to view the interior of the washer or dryer without opening the door.

(2) Description of the Related Art

When the door of a horizontal axis washer or clothes dryer is closed, it is desirable to be able to observe the interior of the appliance without opening the appliance's door so as to prevent the loss of accumulated water or heat from the dryer. The typical horizontal axis laundry appliance is comprised of a drum that rotates about a horizontal axis. The only technique normally used in the prior art is for observing the interior of the appliance without opening the appliance's door is utilize an observation window provided in the door. Examples of this former approach are legion, and include U.S. Pat. No. 4,934,559 and U.S. Pat. No. 5,127,169.

A problem with washer or dryer doors having transparent windows is that it is necessary to bend over in order to be able to observe the interior of the appliance. Also, there are various difficulties associated with sealing and insulating the door adequately and keeping the window clean on its interior surface.

A problem associated with clothes washers and dryers having windowed walls is that such viewing systems can be quite expensive and can require extensive structural modifications of the appliance. Further, such devices are believed to provide less than desirable observation of the interior of the appliance. In part, the difficulty associated with viewing the interior of the appliance, whether with a windowed door or a windowed wall, is that the interior light that illuminates the appliance usually is underpowered and poorly placed.

Desirably, a horizontal axis washer or dryer door would provide a highly effective technique for viewing the interior of the appliance. Any such door preferably would be sealed and well insulated, and it would include a lighting system that would effectively illuminate the interior of the appliance.

In the description and claims that follow, reference will be made to various components of the invention and their orientation through the use of such words as "upper," "horizontally," "vertically" and so forth. The use of such words is in conjunction with a door-closed position as will occur during normal use of the invention. It is to be understood is that the use of such terms of orientation is solely for purposes of convenience. The various components of the invention can be disposed in different orientations and can be described by different words of orientation without departing from the teachings of the present invention.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of instrumentalities and combinations particularly pointed out in the appended claims.

SUMMARY OF THE INVENTION

In view of the aforementioned needs, the invention contemplates a highly effective technique for viewing the interior of a horizontal axis washer or dryer while the appliance is operating, without the need to either bend over and look in the side or open the appliance's door.

The horizontal axis washer or dryer has a cavity within which clothes may be washed or dried and a marginal edge defining the boundary of the cavity. The door includes an inner panel that in use closes and seals the appliance's cavity and an outer panel spaced from the inner panel. An upper panel connects the inner and outer panels adjacent their upper edges.

An opening is formed in the inner panel and a first window, preferably in the form of a wide-angle lens, is mounted in the opening in the inner panel. A first light transmissive device is disposed between the inner and outer panels. The first light transmissive device directs light received through the first window toward the upper panel.

An opening is formed in the upper panel within which a second window is mounted. Accordingly, light can pass through the first window, through the first light transmissive device, between the inner and outer panels, and outwardly through the second window. Because the second window is adjacent the upper edges of the inner and outer panels, the user can conveniently view the interior of the appliance with minimal bending. In the preferred embodiment, the first light transmissive device is a negative mirror disposed adjacent the first window.

The invention includes alternative embodiments. A second light transmissive device may be disposed between the inner and outer panels adjacent the second window. In one alternate embodiment, the second light transmissive device comprises a mirror surface coating on the surface of a viewing tube which extends from the first window to the second window. In another alternative embodiment, the first light transmissive device is a concave lens and the second light transmissive device is a light pipe that receives light from the concave lens and directs it through a wide angle lens onto an enlarged second window.

In order to adequately illuminate the interior of the appliance, a light is secured to the inner panel and is positioned so as to illuminate the interior of the appliance when the door is closed. In an alternative embodiment, two such lights are provided, one on either side of the first window. Desirably, the lights are low-voltage halogen lights to which electrical current is supplied by contacts carried by the inner panel and the marginal edge of the appliance. The contacts engage each other when the door is closed, and are disengaged from each other when the door is opened.

As will be apparent, the invention provides an effective, relatively inexpensive technique for viewing the interior of the washer or dryer without opening the door. Among is those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DESCRIPTION OF DRAWINGS

The drawings illustrate the best mode presently contemplated of carrying out the invention.

DETAILED DESCRIPTION OF INVENTION

Figure 1:
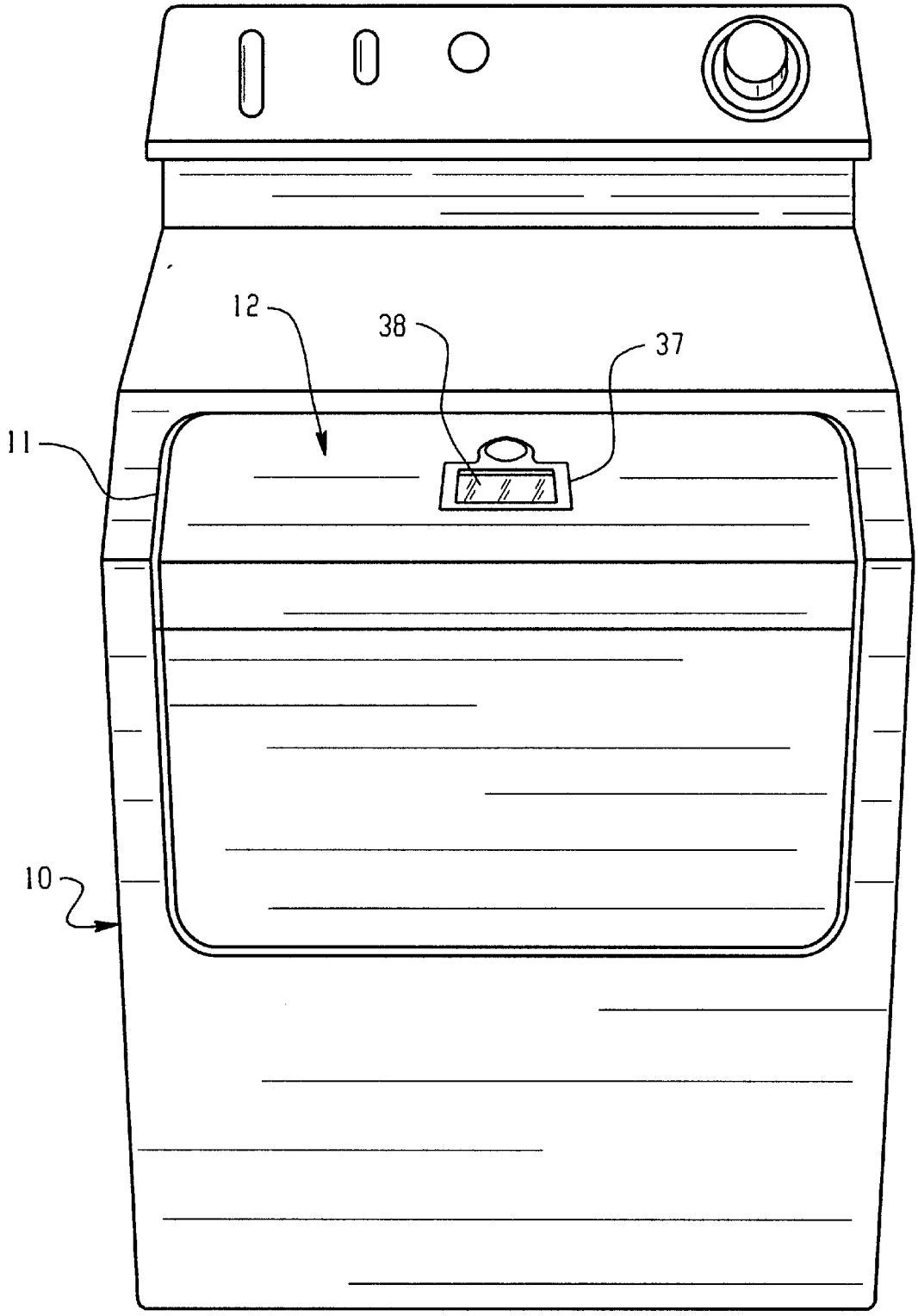
FIG. 1 is a perspective view of a horizontal axis laundry appliance according to the invention.
Figure 2:
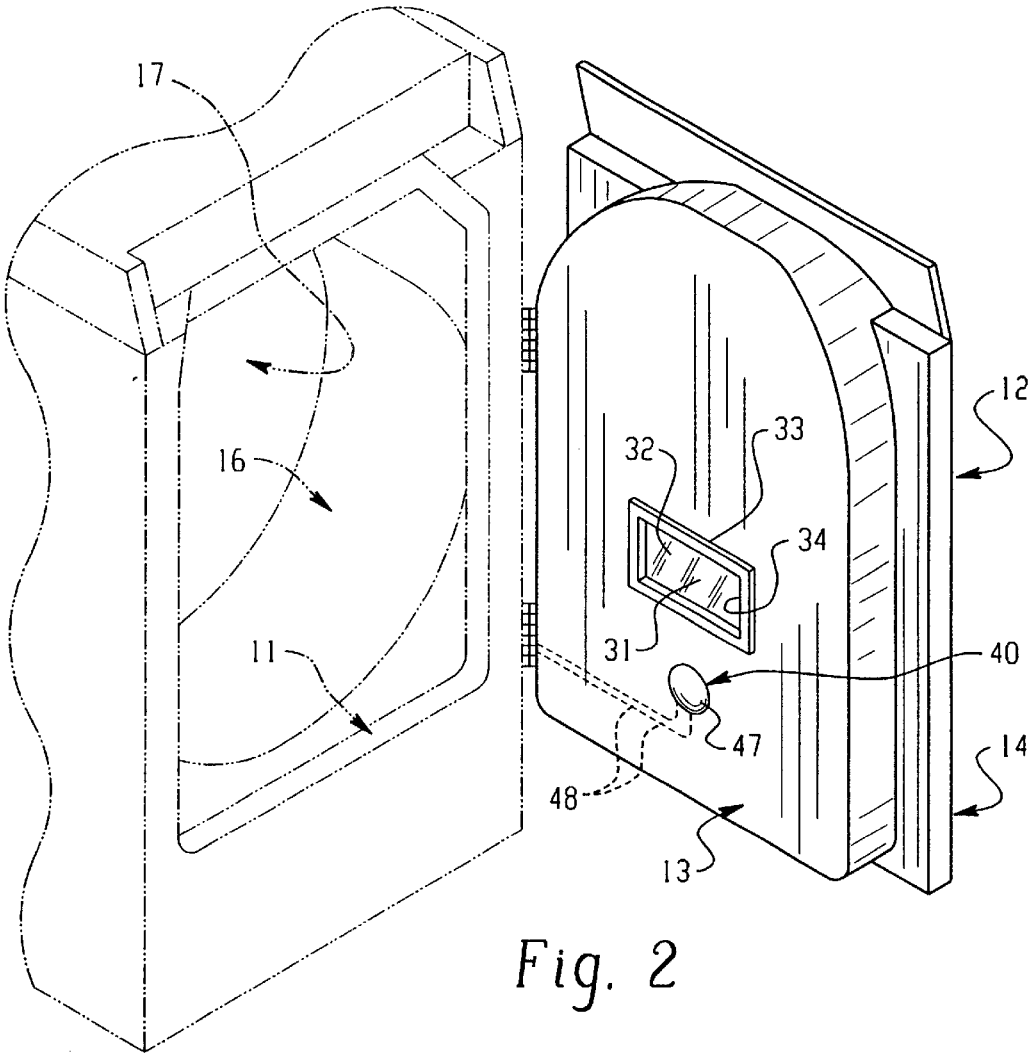
FIG. 2 is a perspective view of a horizontal axis laundry appliance with the door open according to the invention.

Referring to FIG. 1, horizontal axis laundry appliance according to the invention is indicated generally by the reference numeral 10. As best shown in FIG. 2, the appliance 10 has a cavity 17 which includes a marginal edge 11 that defines the external boundary of the appliance 10. The appliance 10 includes a door 12 that closes and provides access thereto when needed. The typical horizontal axis laundry appliance has a drum assembly 16 which rotates during normal operation in order to agitate the items being either washed or dried.

Figure 3:
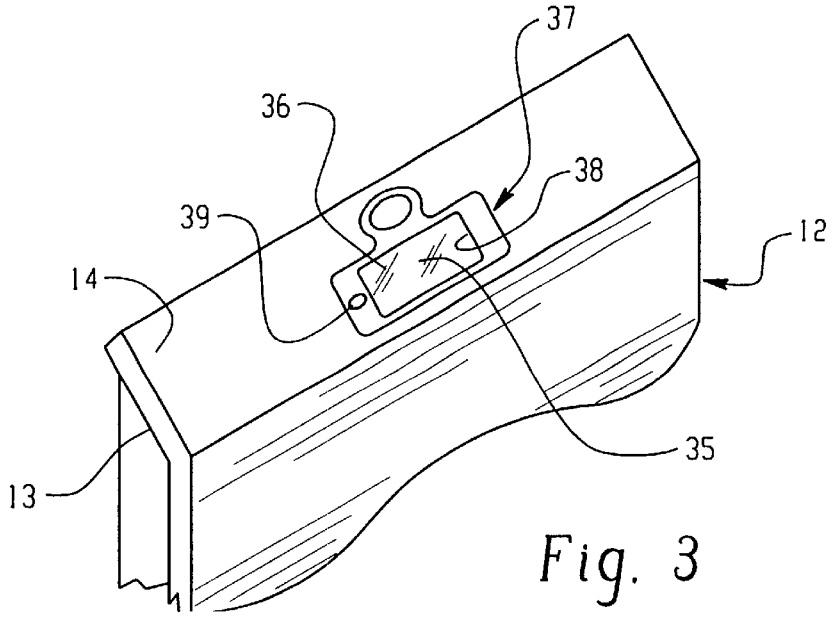
FIG. 3 is a perspective view of a horizontal axis laundry appliance according to the invention, showing a viewing system whereby a user can view the interior of the appliance without opening the appliance door.

Referring now to FIGS. 2 and 3, the door 12 includes an inner panel 13 and an outer panel 14 of low carbon steel. . The panels 13, 14 are parallel to each other but are spaced apart so as to form a chamber 15, as shown in FIG. 4.

Figure 4:
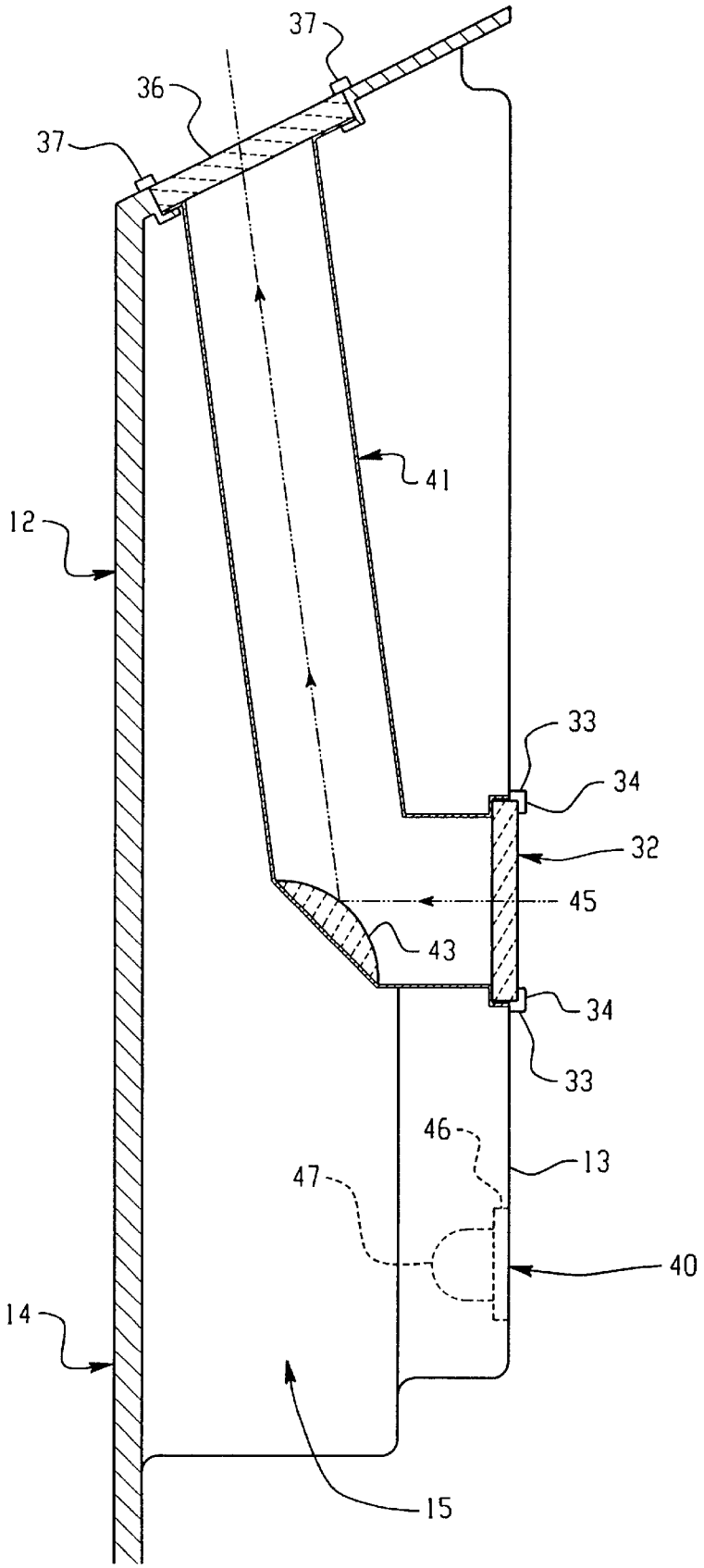
FIG. 4 is a cross-sectional view of the door FIG. 1 taken along a plane through the center of the viewing system.
Figure 8:
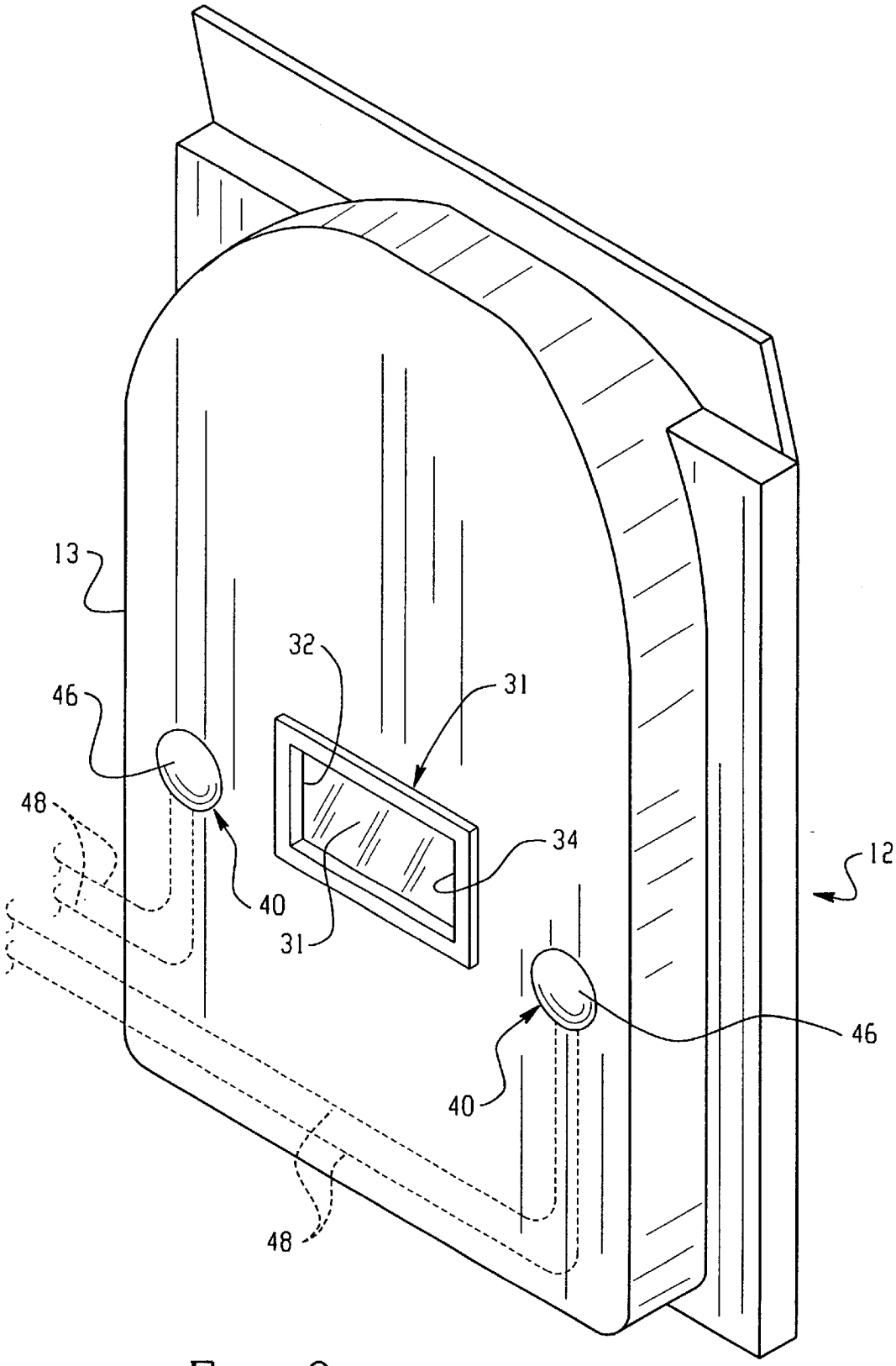
FIG. 8 is a view of the clothes appliance door showing the viewing system with an embodiment that uses two lights.

Referring to FIG. 4, the horizontal axis laundry appliance 10 includes a viewing system that is incorporated into the door 12. Referring to FIGS. 2 and 8, an opening 31 is formed in the inner panel 13. A window 32 is disposed in the opening 31. The plate 33 includes a beveled portion 34 that defines a portion of the opening 31. The beveled portion 34 holds the lens 32 in place.

FIG. 3 shows the portion of the viewing system that the user looks into in order to view the contents of the horizontal axis laundry appliance 10. An opening 35 is formed on the outer panel 14 of the door 12. A window 36 is disposed in the opening 35. The plate 37 holds the lense 36 into place. A light switch 39 is mounted on the plate 37 allowing lights inside the appliance er to be turned on and off from the panel.

Referring to FIG. 4, the preferred embodiment, a viewing tube 41 extends from the window 32 to the viewing window 36. Mounted on the tube behind the window 32 is a negative mirror 43. The path of light through the viewing system is indicated by the reference numeral 45. Light enters the viewing tube 41 via the window 32. The negative mirror 43 causes the light to be reflected upwards towards the viewing window 36.

Figure 5:
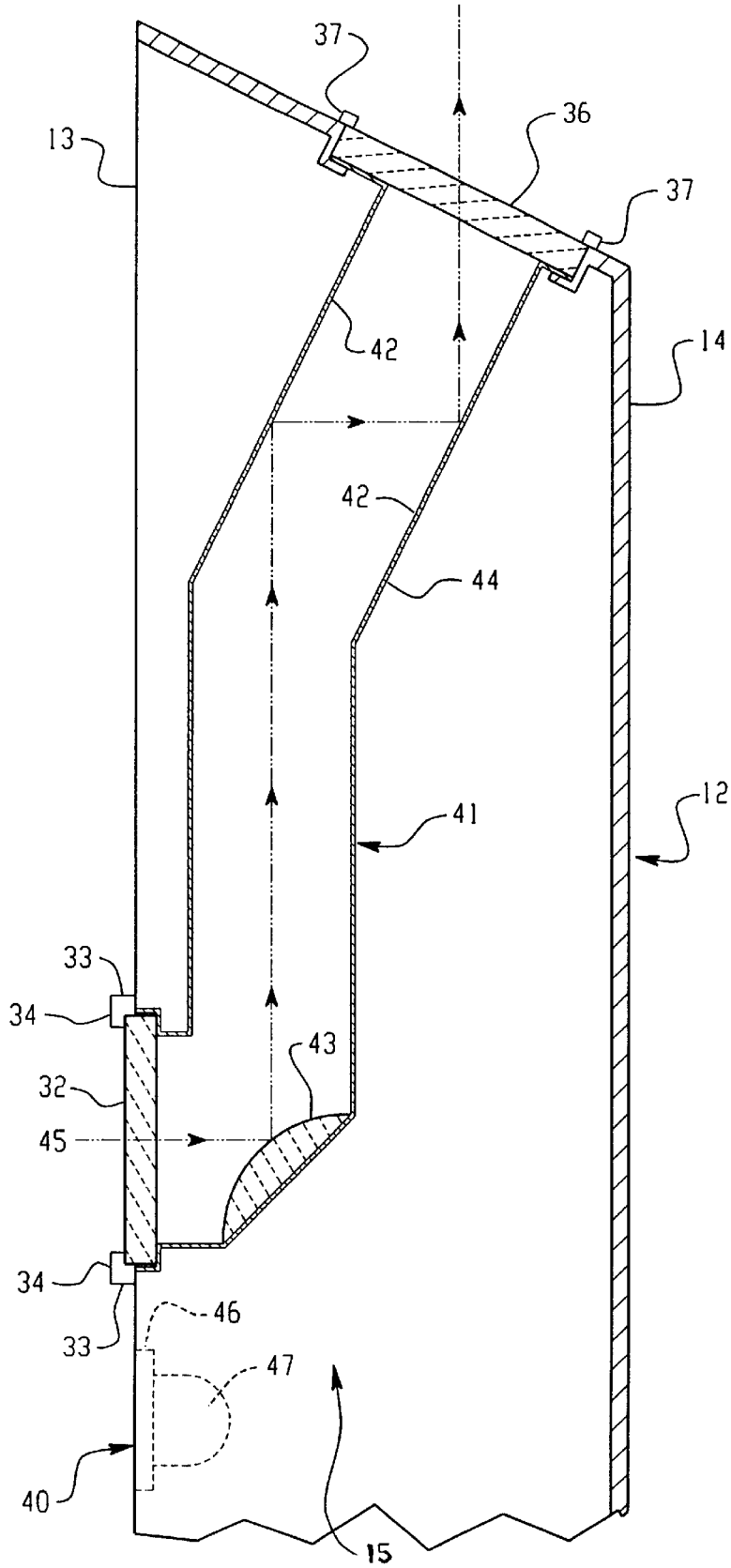
FIG. 5 is a cross-sectional view similar to FIG. 4 showing another type of viewing system included as part of the invention.

Referring to FIG. 5, an alternative embodiment, a viewing tube 41 extends from the window 32 to the viewing window 36. In this embodiment, the tube itself is coated with a mirror surface 42. Mounted on the tube behind the window 32 is a negative mirror 43. The path of light through the viewing system is indicated by the reference numeral 45. Light enters the viewing tube 41 via the window 32. The negative mirror 43 causes the light to be reflected upwards towards the mirrored surface 42. The light is then reflected to the mirrored surface 42 on the opposite side of the viewing tube 41 where the light is then reflected upwards towards the viewing window 36.

Referring to FIGS. 2, 4 and 5, a light 40 is mounted on inner panel 13 of the door 12 in order to illuminate the interior of the appliance . The light includes an opening 46 that is formed on the door's 12 inner panel 13 located underneath the window 32. A low voltage halogen lamp 46 is disposed in the opening. Electrical leads 47 supply current to the lamp 46.

Figure 7A:
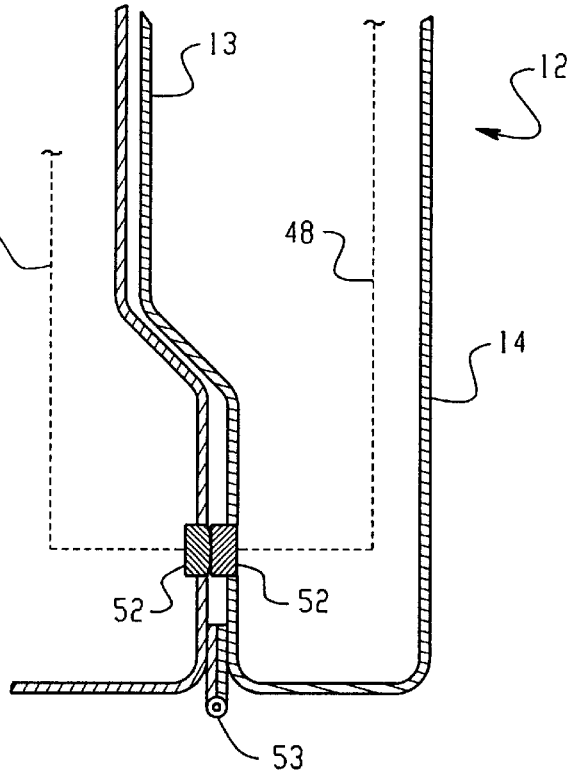
FIGS. 7A and 7B are schematic, cross-sectional views of electrical contacts that are used to supply current to lights included as part of the viewing system according to the invention, the contacts in FIG. 7A being closed and the contacts in FIG. 7B being open
Figure 7B:
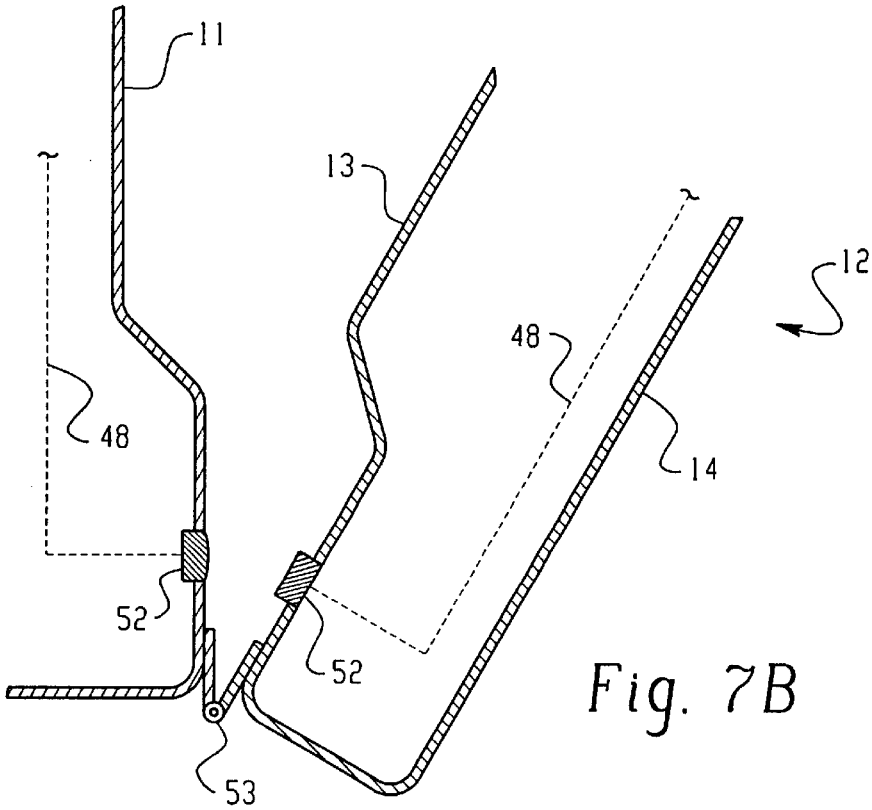

Referring to FIGS. 7A and 7B, a pair of electrical contact 52 are carried by the inner panel 13 and the marginal boundary 11. Upon opening or closing the door 12 by means of a hinge 53, the contacts 52 either will be closed (FIG. 7A) or opened (FIG. 7B). A push button, and preferably, a touch icon capacitance switch (FIG. 1) is included as part of the top plate 37. Upon touching the button 39, the lamp 47 can be activated whenever desired. However, whenever the door 12 is opened as shown in FIG. 7B, the contacts 52 will be disengaged so as to interrupt current to the lamp 47 regardless of the position of the button 39. The use of make-and-break contacts is preferable to hard wiring which can fail prematurely. Preferably, lamps 47 comprise 12 volt, 20 amp halogen bulbs.

Figure 6:
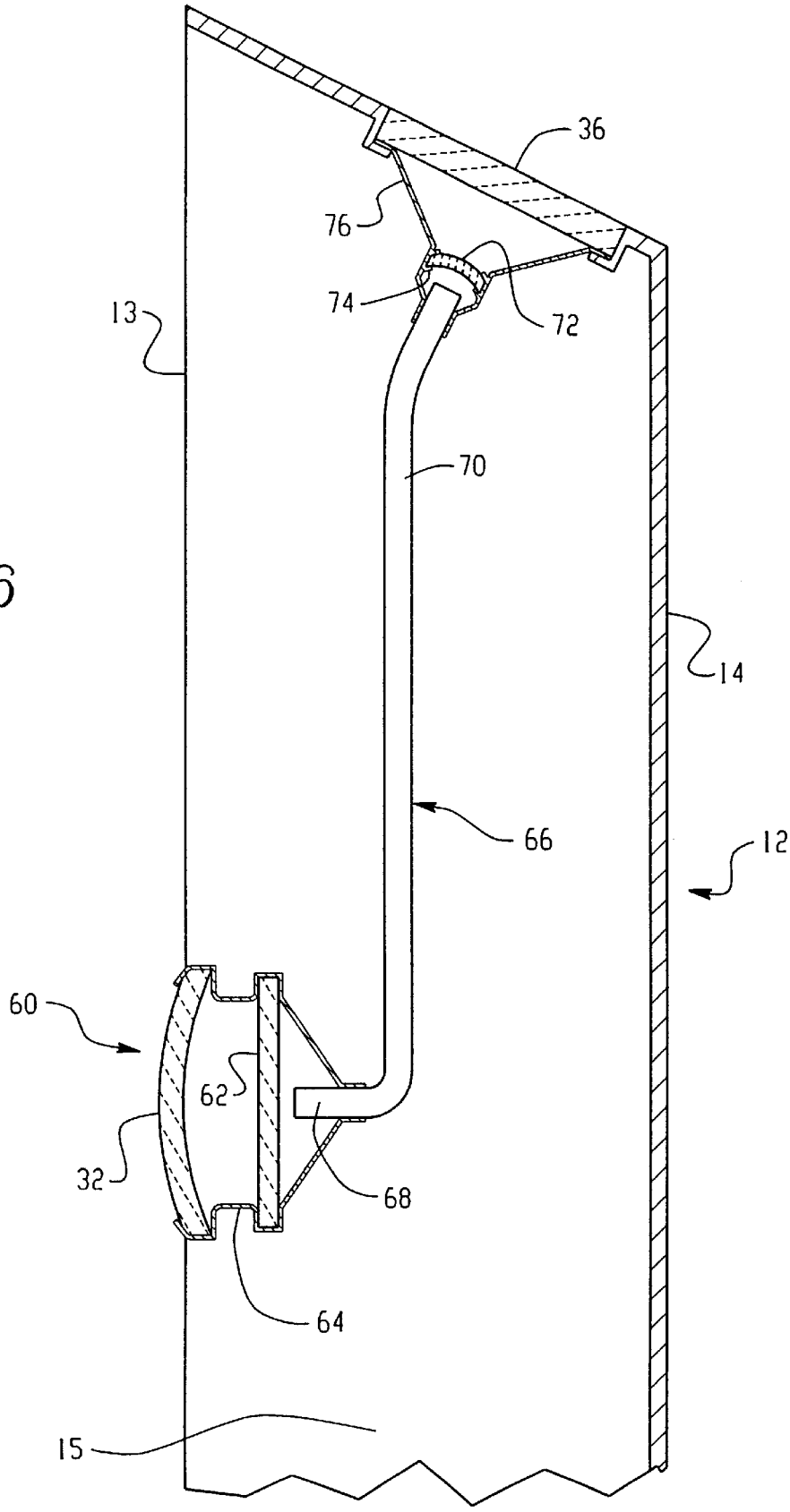
FIG. 6 is a cross-sectional view similar to FIG. 4 showing yet another type of viewing system included as part of the invention.

Referring now to FIG. 6, another alternative embodiment of the invention is indicated generally by the reference numeral 60. In this embodiment of the invention, a concave lens 62 is disposed adjacent the lens 32. The lens 62 is held in place by a lens holder/spacer 64. In the embodiment 60, a second light transmissive device includes a light pipe 66. The light pipe 66 has a first end 68 disposed adjacent the concave lens 62 and a second end 70 that is remote from the lens 62. A wide-angle lens 72 is disposed adjacent the second end 70. A pair of brackets 74, 76 hold the lens 72 and the second end 70 close to each other. As will be apparent from an examination of FIG. 6, light passing through the lens 72 and the lens 62 will be transmitted by the light pipe 66. Upon passing through the lens 72, the light will be projected onto the window 36. The window 36 is inclined at an angle of approximately 45 degrees to the horizontal.

Referring now to FIG. 8, yet another embodiment of this invention, the dryer door 12 includes a pair of lights 40 that are included as part of the door 12. The lights 40 include an opening 46 that is formed in the inner panel 13 on either side of the lens 32 at approximately the same vertical elevation as the lens 32. The openings 46 are formed in a manner similar to the opening 31. A low voltage halogen lamp 47 is disposed in each opening 46. Electrical leads 48 supply current to the lamps 47.

It will be appreciated that although in the attached drawings the viewing systems appear fairly large (wide), in reality such systems will be considerably thinner, such systems being enlarged in order to facilitate a clear illustration of the viewing system and related parts.

It will be appreciated from the foregoing description that the invention provides a highly effective technique for viewing the interior of a horizontal axis laundry appliance . The viewing system enables the user to view the interior of the appliance without bending over or opening the door. The viewing system can be implemented easily without requiring any modification of existing horizontal axis laundry appliances except to add suitable electrical contacts for the electric lights carried by the door. The door is well insulated in an inexpensive, effective manner. The viewing system is more energy efficient than conventional door-mounted windows. Moreover, the door-carried lighting system illuminates the interior of the appliance better than conventional lighting techniques, in part because glare is reduced and illumination is more even.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A horizontal axis laundry appliance for washing or drying clothes, the appliance having a cavity, a marginal edge defining the boundary of the cavity, and a door, the door including an inner panel that faces the cavity and an outer panel generally parallel with and spaced from the inner panel, the inner and outer panels being connected adjacent their upper edges by an upper panel, the door comprising:

an opening in the inner panel;

a first window mounted in the opening in the inner panel;

a first light transmissive device disposed between the inner and outer panels, the first light transmissive device directing light received through the first window toward the upper panel;

an opening in the upper panel;

a second window mounted in the opening in the upper panel.

2. The appliance of claim 1, wherein the first light transmissive device is a negative mirror.

3. The appliance of claim 1, wherein the first window is in the form of a wide-angle lens.

4. The appliance of claim 1, further comprising a first light secured to the inner panel and disposed so as to illuminate the interior of the appliance when the door is closed.

5. The appliance of claim 4, wherein the first light is a low voltage halogen lamp.

6. The appliance of claim 5, further comprising a second light secured to the inner panel and disposed so as to illuminate the interior of the appliance when the door is closed, the first window being disposed at approximately the center of the inner panel, and the first and second lights being disposed on either side of the first window in approximate alignment with the first window.

7. A horizontal axis laundry appliance for washing or drying clothes, the appliance having a cavity, a marginal edge defining the boundary of the cavity, and a door, the door including an inner panel that faces the cavity and an outer panel generally parallel with and spaced from the inner panel, the inner and outer panels being connected adjacent their upper edges by an upper panel, the door comprising:

an opening in the inner panel;

a first window mounted in the opening in the inner panel;

a first light transmissive device disposed between the inner and outer panels, the first light transmissive device directing light received through the first window toward the upper panel;

an opening in the upper panel;

a second window mounted in the opening in the upper panel;

a second light transmissive device disposed between the inner and outer panels adjacent the second window, the second light transmissive device receiving light from the first light transmissive device and directing it towards the second window.

8. The appliance of claim 7 wherein the first light transmissive device is a negative mirror.

9. The appliance of claim 7, wherein the second light transmissive device is a surface coated mirror.

10. The appliance of claim 7 wherein the first window is in the form of a wide angled lens.

11. The appliance of claim 10, wherein the first light transmissive device is a concave lens that is disposed adjacent to the wide-angle lens.

12. The appliance of claim 11, wherein the second light transmissive device includes a convex lens and a light pipe having first and second opposed ends, the first end of the light pipe being disposed adjacent the concave lens and the second end of the light pipe being disposed adjacent the convex lens, the convex lens receiving light from the light pipe and directing it onto the second window.

13. The appliance of claim 7, further comprising a first light secured to the inner panel and disposed so as to illuminate the interior of the appliance when the door is closed.

14. The appliance of claim 13, wherein the first light is a low voltage halogen lamp.

15. The appliance of claim 14, further comprising electrical contacts carried by the inner panel and the marginal edge of the appliance, the contacts engaging each other when the door is closed in order to conduct electrical current to the first light.

16. The appliance of claim 15, further comprising a second light secured to the inner panel and disposed so as to illuminate the interior of the appliance when the door is closed, the first window being disposed at approximately the center of the inner panel, and the first and second lights being disposed on either side of the first window in approximate alignment with the first window.

17. A horizontal axis laundry appliance for washing or drying clothes, the appliance having a cavity, a marginal edge defining the boundary of the cavity, and a door, the door including an inner panel that faces the cavity and an outer panel generally parallel with and spaced from the inner panel, the inner and outer panels being connected adjacent their upper edges by an upper panel, the door comprising:

an opening in the inner panel;

a first window mounted in the opening in the inner panel;

a first light secured to the inner panel and disposed so as to illuminate the interior of the appliance when the door is closed;

an optional second light secured to the inner panel;

a light transmissive device disposed between the inner and outer panels, wherein the light transmissive device is a negative mirror, the light transmissive device directing light received through the first window toward the upper panel;

an opening in the upper panel;

a second window mounted in the opening in the upper panel.

18. The appliance of claim 17, wherein the first and second lights are on either side of the first window in approximate alignment with the first window.

* * * * *